US007406906B2

(12) United States Patent
Beal

(10) Patent No.: US 7,406,906 B2
(45) Date of Patent: Aug. 5, 2008

(54) METHOD FOR ENHANCEMENT OF THE FLIGHT PATH OF AN AMMUNITION PROJECTILE AND PRODUCT

(75) Inventor: Harold F. Beal, Rockford, TN (US)

(73) Assignee: Doris Nebel Beal Inter Vivos Patent Trust, Rockford, TN (US)

( * ) Notice: Subject to any disclaimer, the term of this patent is extended or adjusted under 35 U.S.C. 154(b) by 42 days.

(21) Appl. No.: 11/612,734

(22) Filed: Dec. 19, 2006

(65) Prior Publication Data

US 2008/0141890 A1 Jun. 19, 2008

(51) Int. Cl.
*F42B 30/02* (2006.01)

(52) U.S. Cl. ..... 86/54; 86/55

(58) Field of Classification Search ..... 86/54, 86/55

See application file for complete search history.

(56) References Cited

U.S. PATENT DOCUMENTS 219,840 A * 9/1879 Winchester ..... 86/54
5,079,814 A * 1/1992 Moore et al. ..... 86/55
5,131,123 A * 7/1992 Brooks ..... 86/54
5,471,719 A * 12/1995 Sawyers ..... 86/54
5,544,398 A * 8/1996 Corzine et al. ..... 86/55
5,722,035 A * 2/1998 Matysik et al. ..... 419/28
5,943,749 A * 8/1999 Swank ..... 86/54
6,115,894 A * 9/2000 Huffman ..... 86/55
6,502,625 B2 * 1/2003 Pullum ..... 164/340
6,629,485 B2 * 10/2003 Vaughn et al. ..... 86/55
7,036,433 B2 * 5/2006 Beal ..... 102/519
7,299,733 B2 * 11/2007 Eberhart et al. ..... 86/55
2006/0048666 A1 * 3/2006 Radchenko ..... 102/438

* cited by examiner

*Primary Examiner*—Bret Hayes
*Assistant Examiner*—Daniel J Troy
(74) *Attorney, Agent, or Firm*—Pitts & Brittian, P.C.

(57) ABSTRACT

Method and apparatus for the production of an ammunition projectile having enhanced properties relating to delivery of the projectile along its flight path from a weapon to, and upon striking, a target by reason of the formation of a meplat cavity in the leading end thereof which, from projectile to projectile, exhibits a uniform size, uniform geometry and which is free of extraneous material, and which is concentric with the centerline (spin axis) of the projectile. A round of ammunition is disclosed.

7 Claims, 8 Drawing Sheets

METHOD FOR ENHANCEMENT OF THE FLIGHT PATH OF AN AMMUNITION PROJECTILE AND PRODUCT

CROSS-REFERENCE TO RELATED APPLICATIONS

Not Applicable

STATEMENT REGARDING FEDERALLY SPONSORED RESEARCH OR DEVELOPMENT

Not Applicable

FIELD OF INVENTION

This invention relates to ammunition projectiles, such as projectiles used in rifles and/or pistols. More particularly, this invention relates to enhancement of the flight path of such projectiles and/or enhancement of one or more of other properties of the projectile, such as the lethality of the projectile, the accuracy of delivery of the projectile from a rifle or pistol to a target, including spin stability, etc.

BACKGROUND OF INVENTION

It is well recognized in the art that the accuracy of delivery of projectiles fired from weapons, particularly rifles and pistols, is at least in a substantial part, a function of the rotational stability (at times referred to as "spin stability" of the projectile in the course of the flight of the projectile from the weapon to a target. This factor is particularly important when employing weapons having rifled barrels, i.e., internally helically-grooved barrels.

In similar manner, it is well known in the art that provision of an open tip in the leading end of an ammunition projectile has a profound effect upon the degree and nature of the structural reaction of the projectile upon it striking an intended target. For example, provision of an open tip (herein referred to as a "meplat cavity") in the leading end of a projectile is known to increase the degree of structural change of at least the leading end of the projectile when it strikes a target of a given type. Such changes are to a degree preselectable by weakening of the walls of the meplat cavity employing slits or slots which extend partially through the wall thickness of the meplat cavity, shaping the cross-section of the meplat cavity as a rosette or other geometry, etc. All such known techniques for altering the meplat cavity suffer from the problem of uniformity of the structure of the meplat cavity in the course of its formation and/or modifications to the meplat cavity following its initial formation. Such non-uniformity may take many forms or combination of forms, but all of these are subject to disruption of the spin stability of the projectile during its flight from the weapon to the target, or in the very least, lack of uniformity of spin stability from projectile to projectile of any given production lot of projectiles produced. Similarly, such known prior art techniques commonly fail to provide consistency of projectile deformation, even within the same production lot of projectiles.

Additionally, in the known prior art for the manufacture of ammunition projectiles, there exists the problems of inconsistency in the overall length of a given type of projectile occasioned by the mode of development of the meplat cavity of the projectile, including concomitant inconsistency (a) in the overall length of a metal jacketed core type projectile, (b) in the outer diameter and/or the inner diameter of the outward opening of the meplat cavity, and/or (c) in the rate of reduction in the velocity of the projectiles of a given type in the course of their flight from the weapon to a target.

These and other problems associated with the meplat cavities of the prior art projectiles, and the methods employed in the production of such projectiles, ultimately adversely affect the ballistic of the projectiles.

SUMMARY OF THE INVENTION

A method and apparatus for the production of an ammunition projectile having enhanced properties relating to delivery of the projectile along its flight path from a weapon and a target by reason of the formation of a meplat cavity in the leading end thereof which, from projectile to projectile, exhibits a uniform size, uniform geometry and which is free of extraneous material, and which is concentric with the centerline (spin axis) of the projectile. Apparatus for carrying out the method of the present invention is disclosed. A projectile produced employing the method and apparatus of the present invention and a round of ammunition employing a projectile of the present invention are disclosed.

DETAILED DESCRIPTION OF THE INVENTION

Figure 1:
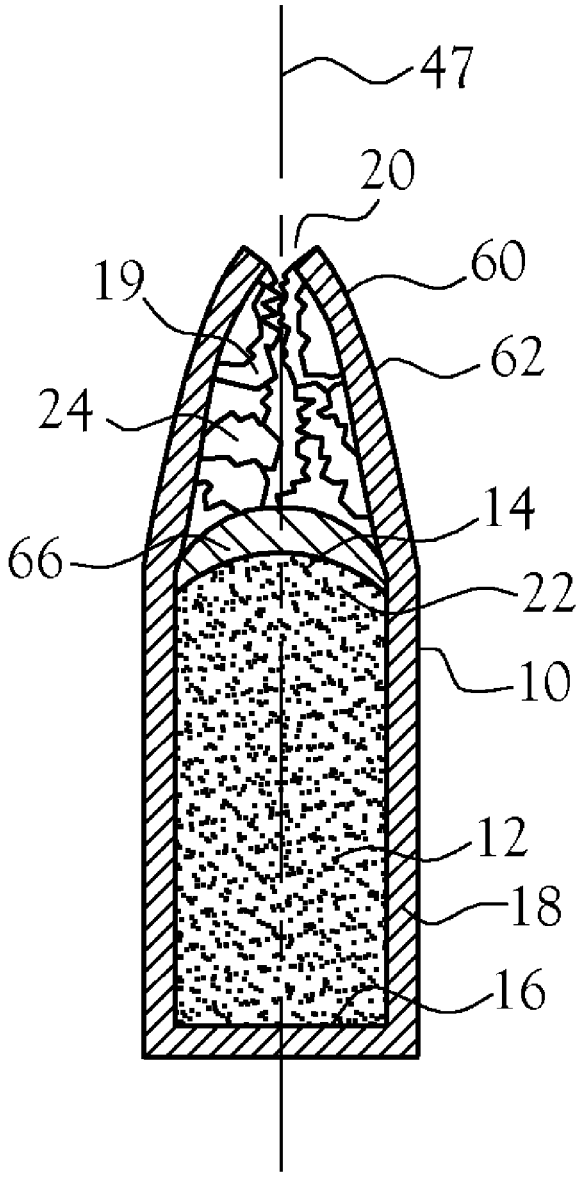
Fig.1 (PRIOR ART)
FIG. 1 is a side view, partly in section, of one embodiment of a prior art projectile.

In FIG. 1 there is depicted a projectile 10 of the prior art comprising a core 12 of a solid material (e.g., metal) or a compressed quantity of one or more metal powders inserted into and seated within a cup-shaped jacket 18 (e.g., copper or brass) to define a jacket/core subassembly. In the depicted projectile, there is included a disc 66 inserted in the jacket in overlying relationship to the leading end of the core. In the depicted projectile, there is defined on the leading end 60 thereof an ogive 62, all as is known in the art. As noted in FIG. 1, the ogive-bearing projectiles of the prior art include extraneous material 19 (i.e. copper or brass) derived from the leading end of the jacket in the course of formation of the ogive. This extraneous material effectively occludes the desired formation of a meplat cavity void of any solid material, in the leading end of the projectile.

Figure 2:
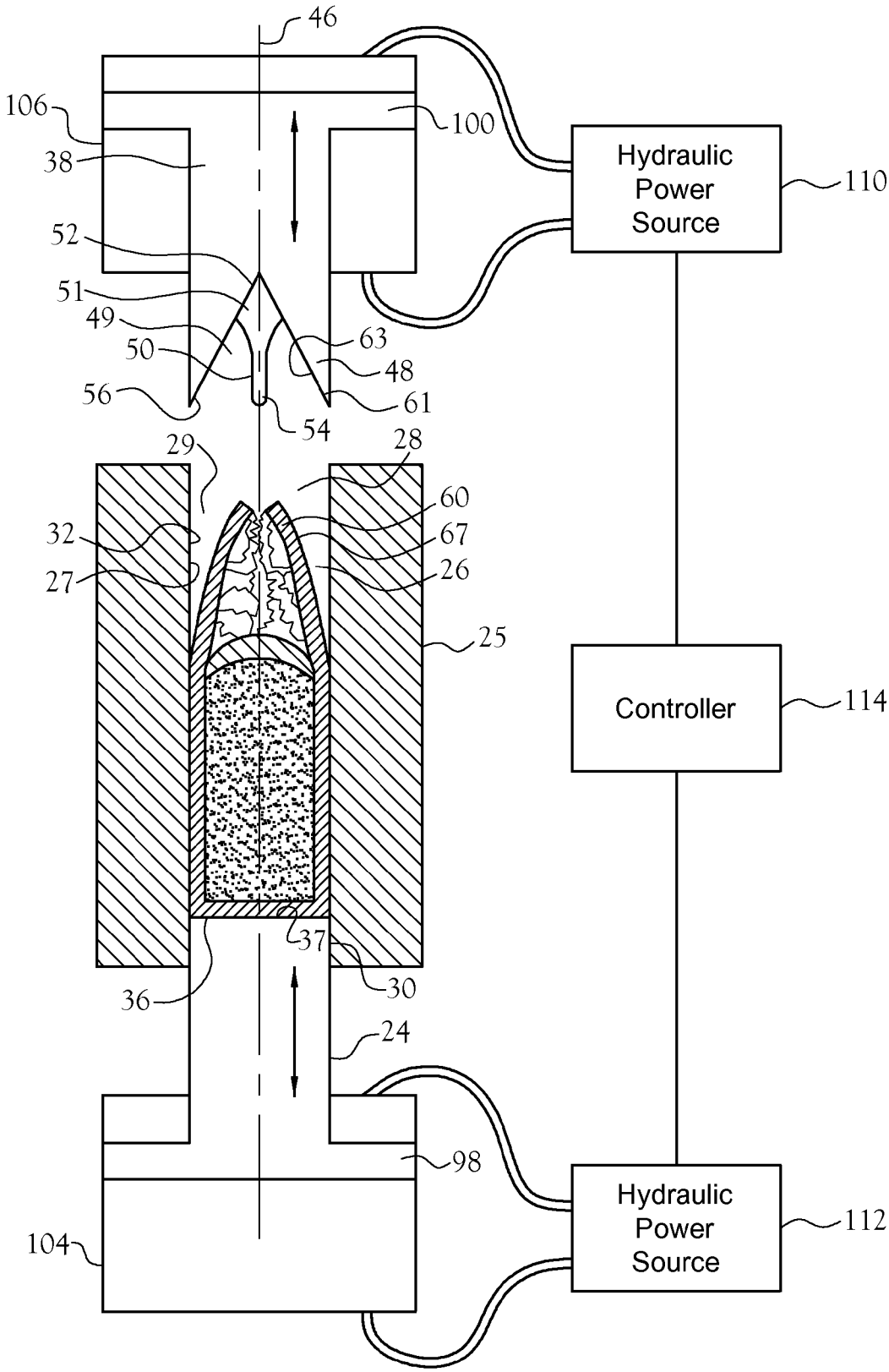
FIG. 2 is a schematic representation of one embodiment of apparatus for carrying out the method of the present invention.
Figure 3:
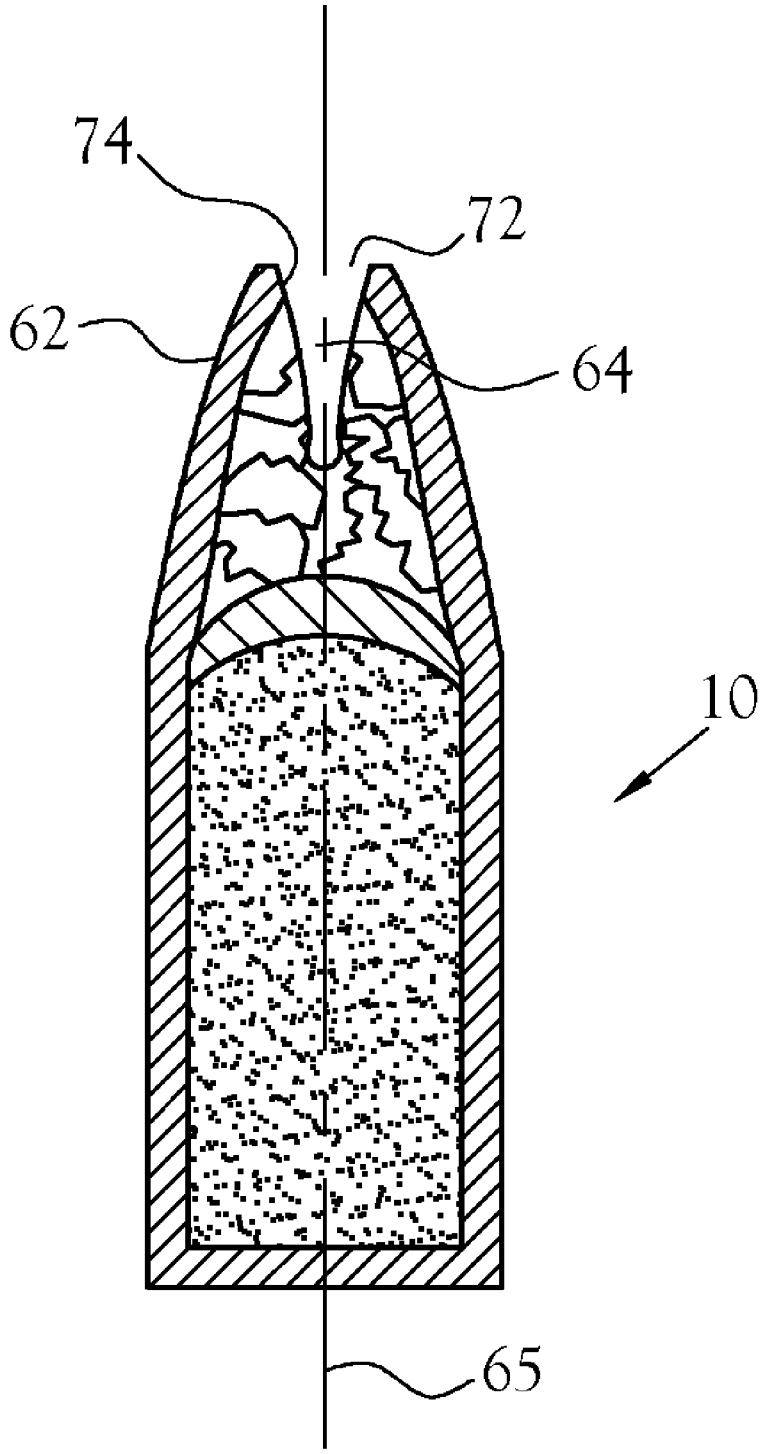
FIG. 3 is a side view, partly in section of a projectile produced employing the method and apparatus of the present invention.
Figure 4C:
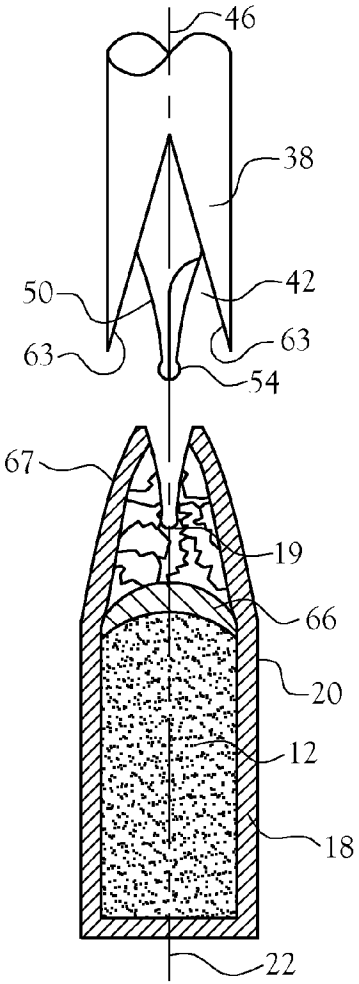
FIG. 4C is a still further representation of that portion of the embodiment of apparatus depicted in FIG. 4A and depicting various steps of one embodiment of the method of the present invention.
Figure 4B:
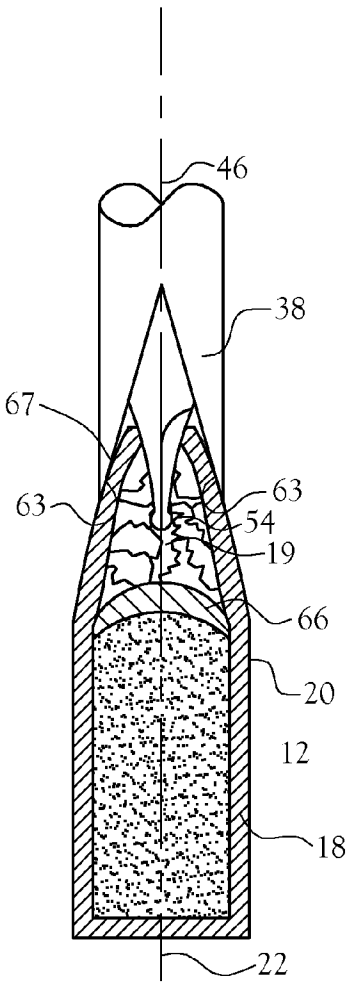
FIG. 4B is a further representation of that portion of the embodiment of apparatus depicted in FIG. 4A and depicting various steps of one embodiment of the method of the present invention.
Figure 4A:
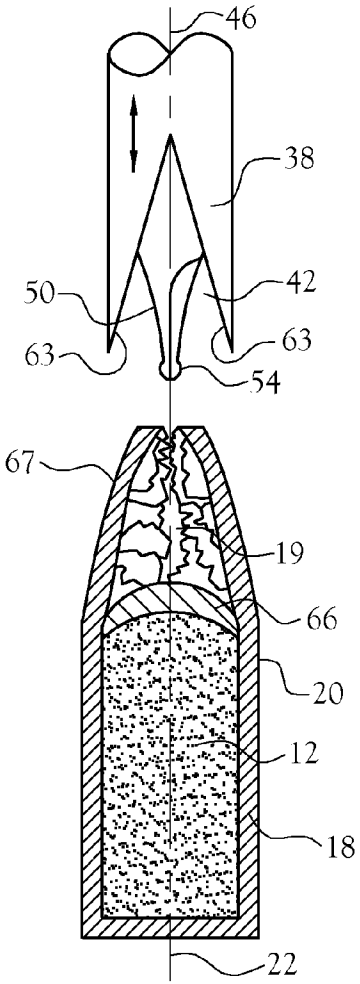
FIG. 4A is a representation of a portion of the embodiment of apparatus depicted in FIG. 2 and depicting various steps of one embodiment of the method of the present invention.

Referring to FIG. 2, an ogive-bearing projectile 10 of the prior art serves as a starting point for the present invention. In one aspect of the method of the present invention, the steps include (a) providing a die 25 having an elongated cavity 26 with a substantially straight inner wall 27 and open top and bottom ends 28 and 30, respectively, (b) closing the bottom end of the die cavity with a reciprocating bottom punch 24, (c) inserting the projectile into the die cavity with the trailing end 36 of the projectile in supported engagement with the inboard distal end 37 of the bottom punch, the depth of the die cavity being preferably slightly greater than the length of the projectile so that essentially all of the projectile is disposed substantially within the die cavity, (d) providing a top punch 38 adapted to be reciprocally received within the top end 28 of the die cavity with its longitudinal centerline 46 disposed concentric with the longitudinal centerline 47 of the projectile disposed within the die cavity, such top punch including an inboard distal end 48 having a substantially conical depression 42 extending concentrically inwardly along the length of the top punch and a generally conical projection 50 disposed concentrically of the depression and having its base 51 located at the pinnacle 52 of the depression and its own pinnacle 54 terminating coplanar with the projected base 56 of the depression, (e) inserting the top punch into the top end of the die cavity adjacent the leading end of the projectile to the extent that the outer rim 61 of the depression and the pinnacle 54 of the projection engage the leading end of the projectile, and (f) urging the top punch toward the bottom punch with resultant entry of the projection of the top punch into the leading end of the projectile and displacement of extraneous material 19 laterally of the inwardly moving projection and either laterally and/or vertically upwardly within that portion of the leading end of the jacket which is not occupied by either the core or a disc overlying the leading end of the core, thereby defining a generally conical meplat cavity of uniform size and geometry in the leading end of the projectile which is void of extraneous material and disposed concentrically with respect to the longitudinal centerline 47 (spin axis) of the projectile and simultaneously defining a uniformly sized outward opening 72 for the meplat cavity which also is concentric with the longitudinal centerline 47 of the projectile and which exhibits a smooth surfaced annular face 74 of selectable wall thickness, on the projectile.

Contrary to the prior art projectiles, the present inventor has found that formation of a concentrically disposed meplat cavity of uniform size and geometry and void of extraneous material, and having an enhanced meplat outward opening in the leading end of a projectile provide major advantages with respect to the flight characteristics (external ballistics) of a projectile and with respect to the terminal ballistics of the projectile when it strikes an intended target. These advantages specifically include uniformity of external and terminal ballistics from projectile to projectile of a given caliber, type, size, etc. All these enhancements of the leading end of the projectile, in the present invention, are accomplished employing a single tool and a simple mechanical operation in the overall method of manufacture of the projectile of the present invention.

With reference to FIGS. 2 and 4A-4C, there is depicted one embodiment of apparatus useful in carrying out the method of the present invention and includes a die 25 having an elongated die cavity 26 open at its leading (top) and trailing (bottom) ends, 28 and 30, respectively, and having a substantially cylindrical central straight-sided inner wall portion 27 adapted to receive concentrically therein an ogive-bearing projectile 10. In the depicted embodiment, the bottom end of the die cavity is closed as by a reciprocatable bottom punch 24 whose position within the die cavity is preselected and fixed. As depicted, the trailing end of the projectile 36 engages the distal face 37 of the bottom punch to establish the depth to which the projectile may extend into the die cavity.

The overall length of the die cavity is chosen to be slightly greater than the overall length of the projectile thereby providing open space 29 within the top end of the die cavity into which there is received the distal end 48 of a reciprocatable top punch 38. As shown in FIG. 2, the distal end of the top punch is provided with a substantially conical depression 49, the base 56 of which defines a circular outer rim 61 which occupies a projected plane that is oriented perpendicular to the longitudinal centerline 47 of the projectile. As depicted in FIG. 2, the distal end 48 of the top punch is also provided with a generally conical projection 50, the base 51 of which occupies a substantial portion of the pinnacle 52 of the depression 49 and which extends from the pinnacle of the depression outwardly such that its pinnacle 54 terminates coplanar with the projected plane of the base of the conical depression. As noted, movement of this top punch inwardly of the die cavity results in the forceful entry of the outboard end of the projection into the leading end of the projectile. Importantly, as the projection is engaging and entering the leading end of the projectile, the inner wall 63 of the conical depression engages the outer wall 67 of the jacket of the projectile and precludes any material lateral movement of that portion of the jacket adjacent the leading end 60 of the jacket, while simultaneously permitting compaction of extraneous material within the leading end of the ogive portion of the jacket. The result is compression of extraneous material within the open space 29 ahead of the inwardly moving top punch between the projection and the inner wall of the depression so that when the top punch is withdrawn from the die cavity, there exists within the leading end of the projectile the desired meplat cavity which is devoid of extraneous material and without material distortion of the outer surface of the leading end of the projectile. Through selection of the depth to which the conical projection is inserted into the leading end of the projectile, the wall thickness of the annular outer face 74 of the meplat cavity may be selectable over a range determined by such depth of insertion and the degree of inclination of the outer wall of the conical projection.

In one embodiment of the apparatus employed in carrying out the steps of the method of the present invention, the top and bottom punches include a respective outboard ends 98 and 100 which are captured within respective cylinders 104 and 106 such that each punch functions in the nature of a piston in a hydraulic piston/cylinder device. Reciprocation of the top and bottom punches may be provided by means of hydraulic power sources 110, 112 having a central controller 114 which establishes and controls both the reciprocatory movements of the punches and the depth to which each punch enters into the die cavity, all as is commonly known in the art. As desired, the reciprocatory movements of the two punches may be simultaneous or may be effected independently of one another. In either event, it is preferred that the bottom punch be engaged with the trailing end of the projectile before the top punch engages the leading end of the projectile thereby providing for rigid positioning of the projectile within the die cavity prior to any material enhancement of the leading end of the projectile by the advancing top punch. Alternatively, as desired, the movements of the punches may be effected employing mechanical means, also as known in the art.

Figure 5:
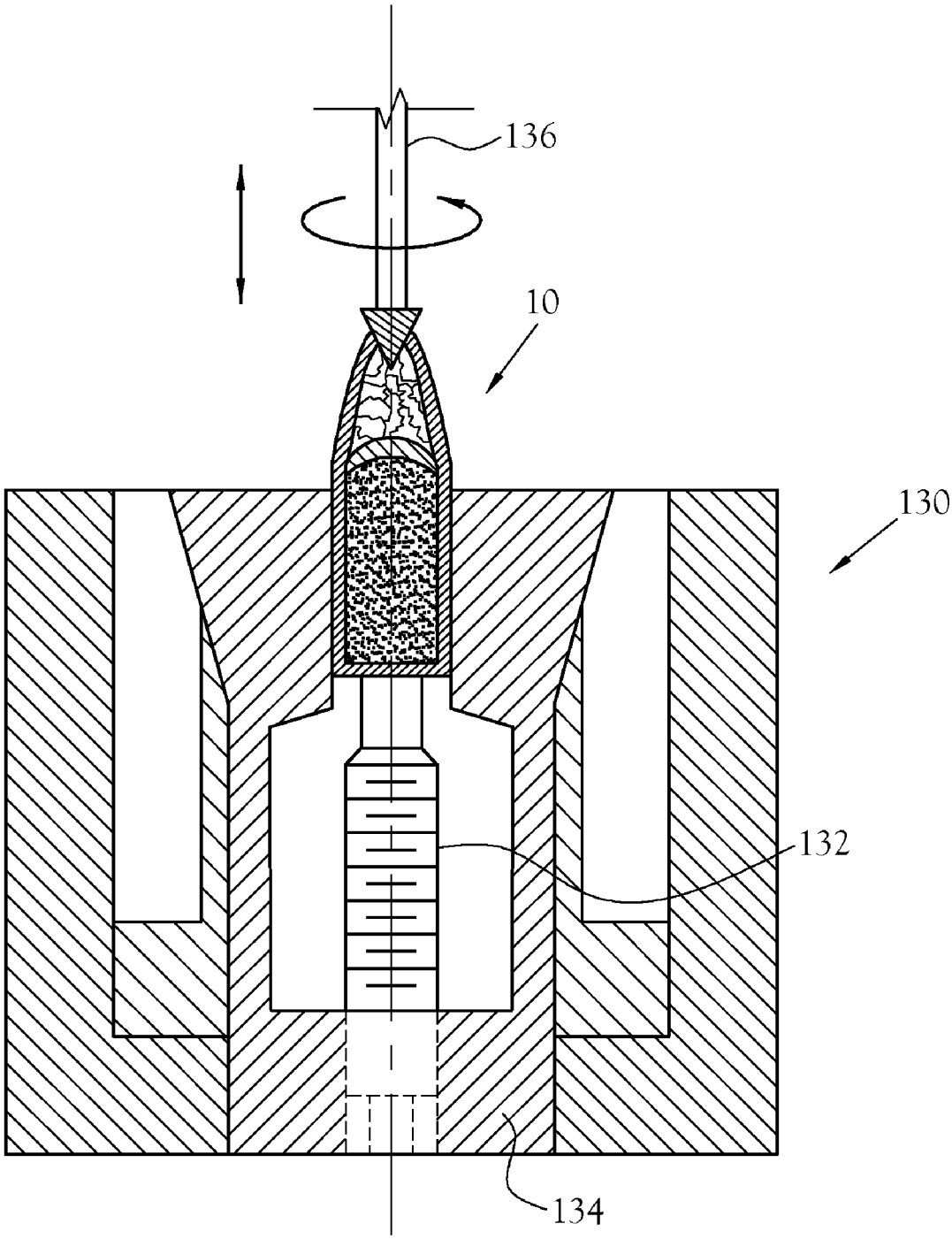
FIG. 5 is a representation of one embodiment of apparatus for releasably holding a projectile of the present invention in position for enhancement of the leading end of the projectile and depicting one embodiment of burnishing the leading end of a projectile in accordance with one aspect of the present invention.
Figure 6:
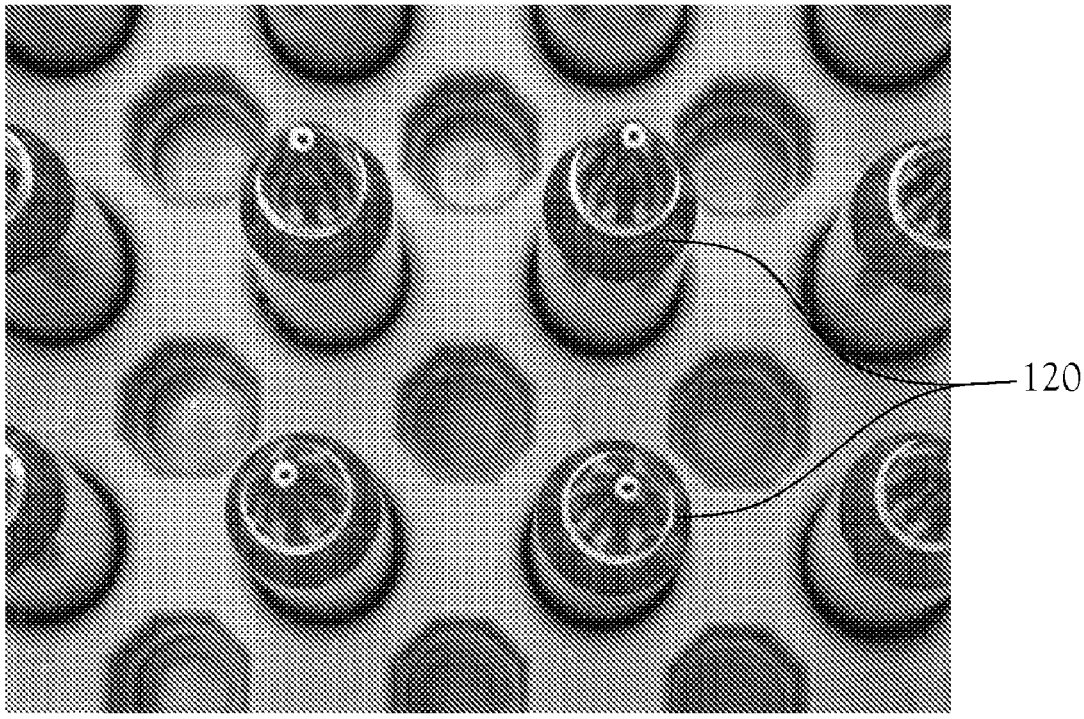
FIG. 6 is an image depicting the leading ends of a plurality of projectiles produced employing the method of the present invention.
Figure 7:
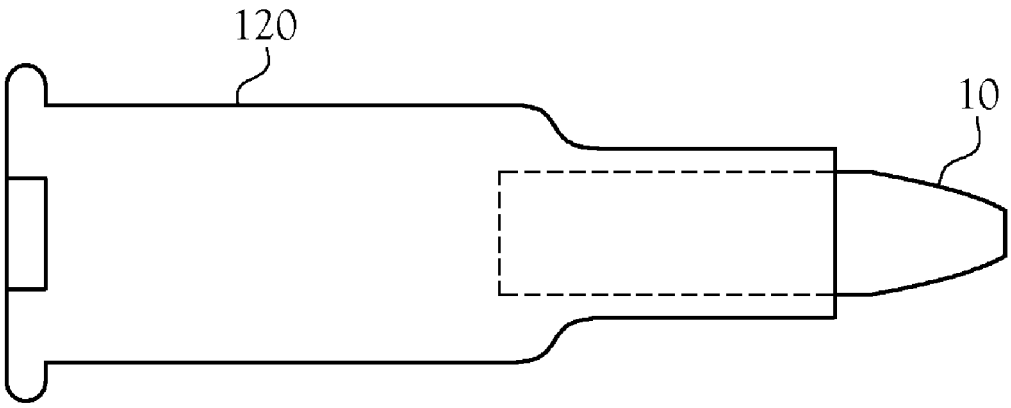
FIG. 7 is a side view representation of a round of ammunition formed employing a projectile of the present invention.

As depicted in FIG. 5, depicts one embodiment for carrying out a burnishing operation on the inner diameter of the annular face of a projectile of the present invention. In this operation, a projectile 10 as formed in accordance with the method of the present invention is releasably mounted within a commercially available collet 130. The depicted collet includes a base 134 having mounted therein a threaded post 132 which provides a limit stop for the degree of insertion of the projectile within the collett. Once inserted and clamped within the collet, the leading end of the projectile is subjected to a light burnishing of the inner diameter of the meplat opening for purposes of removing burrs or like irregularities on or in the inner diameter of the meplat opening, employing a well known burnishing tool 136 which is rotated as it is urged into engagement with the leading end of the projectile.

Employing the apparatus and method of the present invention, it has been found possible to produce, projectile after projectile, in a production-type environment, uniformly sized, shaped and concentrically oriented meplat cavities in each of the projectiles so produced. The present method also has been found to produce projectiles of consistent overall length, rendering these projectiles highly desirable for use in the production of a round of ammunition.

Rounds of ammunition 120 were produced employing projectiles of the present invention. Upon firing of such rounds from a weapon, it was noted that the fired projectiles exhibited reduced frontal drag as they exited the weapon and progressed along their flight path to an intended target. This feature resulted in tighter patterns on the target for multiple shot groups of firings of the rounds. In major part such enhanced external ballistics is attributable, among other things, to the uniformity from projectile to projectile of the wall thickness of the leading end of the jacket, the concentricity of the inner and outer diameter of the leading face of the jacket and of the meplat cavity itself with respect to the longitudinal centerline of the projectile. The ability to reproducibly manufacture the projectiles of the present invention is deemed critical to the present invention and to the knowledge of the present inventor is not known in the art.

Figure 8:
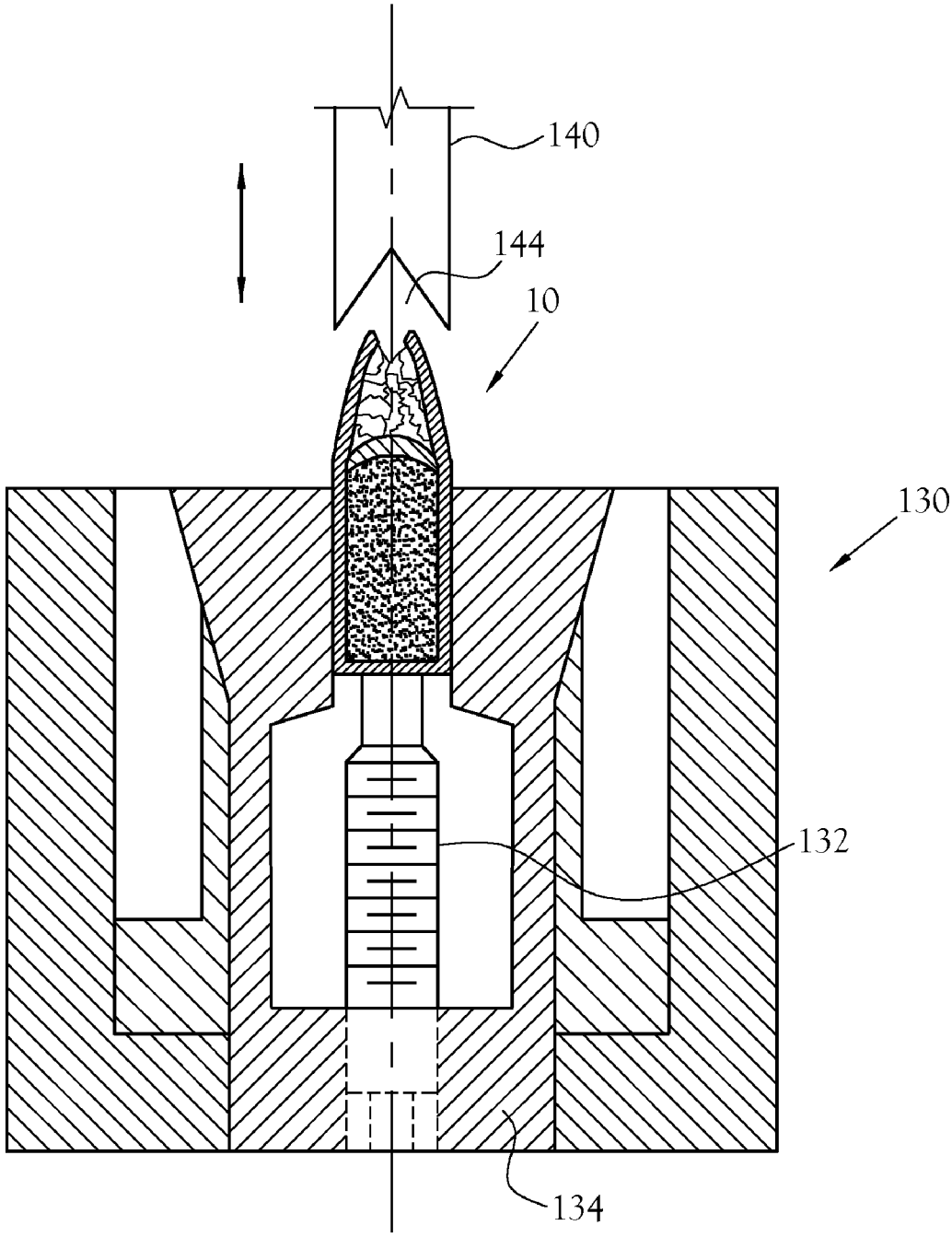
FIG. 8 is a schematic representation of one embodiment of apparatus useful in alternatively tipping the leading end of a projectile after enhancement of the leading end of the projectile.

FIG. 8 schematically depicts an alternative embodiment of the present invention useful in the tipping of the leading end of a projectile produced in accordance with the present invention. In the depicted embodiment, substantially the same apparatus, aside from the top punch, as depicted in FIG. 5. In FIG. 8 a projectile formed employing the present invention is alternatively further subjected to a step in which the leading end of the projectile is tipped. This operation is performed with a top punch 142 having only an open conical depression 144 in its inner distal end, such depression being adapted to receive only a relatively short length of the leading end of the projectile within the conical depression in the distal end of the top punch. In this alternative tipping embodiment, the extreme leading end of the jacket of the projectile is further formed radially inwardly of the projectile by a limited amount to further close the leading end of the jacket, but leaving relatively undisturbed, the void volume of the originally formed meplat cavity and the inner diameter of the meplat cavity. Projectiles of this type exhibit decreased resistance to velocity reduction upon the exiting of the projectile from the muzzle of a weapon.

While the present invention has been illustrated by description of specific embodiments and while the illustrative embodiment has been described in considerable detail, it is not the intention of the inventor to restrict or in any way limit the scope of the present invention. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed:

1. A method for enhancing the flight of a projectile from a weapon comprising the steps of:

(a) providing a die having an elongated cavity with a substantially straight cylindrical inner wall and open top and bottom ends, (b) closing the bottom end of said die cavity with a reciprocating bottom punch having an inboard distal end, (c) providing a projectile including a jacket housing a core therein and having a leading end and a trailing end and an ogive formed on said leading end thereof, (d) inserting said projectile into said die cavity with said trailing end of said projectile in supported engagement with said inboard distal end of said bottom punch, the depth of said die cavity being preferably slightly greater than the overall length of said projectile so that essentially all of said projectile is disposed substantially within said die cavity, (e) providing a top punch adapted to be reciprocally received within said top end of said die cavity with its longitudinal centerline disposed concentric with the longitudinal centerline of said projectile disposed within said die cavity, said top punch including an inboard distal end having a substantially conical depression extending concentrically inwardly along the length of said top punch and a generally conical projection disposed concentrically of said depression and having a projected planar base located at the pinnacle of said depression and its own pinnacle terminating inboard of said projected planar base of said depression, (f) inserting said top punch into said top end of said die cavity adjacent said leading end of said projectile to the extent that said projected planar base of said depression and said pinnacle of said projection engage said leading end of said projectile, and, (g) urging said top punch toward said bottom punch with resultant entry of said projection of said top punch into said leading end of said projectile and displacement of extraneous material disposed within said leading end of said projectile at least laterally of said inwardly moving projection within that portion of said leading end of said jacket which is not occupied by said core, thereby defining a generally conical meplat cavity of uniform size and geometry in said leading end of said projectile which is void of extraneous material and disposed concentrically with respect to the longitudinal centerline of said projectile and simultaneously defining a uniformly sized outward opening for said meplat cavity which also is concentric with the longitudinal centerline of said projectile and which defines a smooth surfaced annular outboard face of selectable wall thickness, on said projectile.

2. The method of claim 1 and including the step of interposing a disc within said jacket and in overlying relationship to said leading end of said core.

3. The method of claim 1 wherein said extraneous material is also displaced vertically upwardly within that portion of said leading end of said jacket which is not occupied by said core.

4. The method of claim 1 wherein said pinnacle of said projection terminates substantially coplanar with said projected planar base of said depression.

5. The method of claim 1 and including the further step of burnishing said meplat opening.

6. The method of claim 1 and including the further step of tipping said leading end of said projectile following formation of said meplat cavity.

7. A projectile manufactured in accordance with the method of claim 1.

* * * * *